US010508635B2

(12) United States Patent
Jagani et al.

(10) Patent No.: US 10,508,635 B2
(45) **Date of Patent: *Dec. 17, 2019**

(54) PIEZO INJECTOR

(71) Applicant: Continental Automotive GmbH, Hannover (DE)

(72) Inventors: Jignesh Jagani, Regensburg (DE); Janos Kerekgyarto, Regensburg (DE); Ivan Krotow, Regensburg (DE); Willibald Schuerz, Pielenhofen (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/649,997

(22) PCT Filed: Dec. 5, 2013

(86) PCT No.: PCT/EP2013/075693
§ 371 (c)(1),
(2) Date: Jun. 5, 2015

(87) PCT Pub. No.: WO2014/086933
PCT Pub. Date: Jun. 12, 2014

(65) Prior Publication Data

US 2015/0292462 A1 Oct. 15, 2015

(30) Foreign Application Priority Data

Dec. 7, 2012 (DE) ..... 10 2012 222 509

(51) Int. Cl.
*F02M 63/00* (2006.01)
*F02M 47/02* (2006.01)

(52) U.S. Cl.
CPC ..... *F02M 63/0026* (2013.01); *F02M 47/027* (2013.01)

(58) Field of Classification Search
CPC ..... F02M 63/0026; F02M 47/027; F02M 2200/703; F02M 2547/001
(Continued)

(56) References Cited

U.S. PATENT DOCUMENTS 6,196,472 B1 3/2001 Cooke ..... 239/88
6,427,968 B1 8/2002 Stoecklein ..... 251/57
(Continued)

FOREIGN PATENT DOCUMENTS

AT 500889 A1 4/2006 ..... F02M 47/02
CN 1712696 A 12/2005 ..... F02M 61/16
(Continued)

OTHER PUBLICATIONS

International Search Report and Written Opinion, Application No. PCT/EP2013/075693, 17 pages, dated Apr. 3, 2014.
(Continued)

*Primary Examiner* — Darren W Gorman
(74) *Attorney, Agent, or Firm* — Slayden Grubert Beard PLLC

(57) ABSTRACT

A piezo injector includes an actuator space in which a piezo actuator is arranged, a control piston bore in which a control piston with an end face is arranged, a leakage pin arranged between the piezo actuator and the end face to couple the piezo actuator with the control piston, and a union for fluidic communication with the control piston bore which union has a hydraulic throttle.

8 Claims, 3 Drawing Sheets

(58) Field of Classification Search
USPC ..... 239/102.2
See application file for complete search history.

(56) References Cited

U.S. PATENT DOCUMENTS

| | | | | |
|---|---|---|---|---|
| 6,581,900 | B1 * | 6/2003 | Stoecklein | F02M 45/04 239/102.2 |
| 7,118,046 | B2 | 10/2006 | Yoshimura et al. | 239/96 |
| 7,216,815 | B2 | 5/2007 | Magel | 239/88 |
| 7,258,283 | B2 | 8/2007 | Heinz et al. | 239/88 |
| 7,309,027 | B2 | 12/2007 | Magel et al. | 239/88 |
| 7,353,806 | B2 | 4/2008 | Gant | 123/498 |
| 7,455,244 | B2 | 11/2008 | Boecking | 239/102.2 |
| 7,926,737 | B2 | 4/2011 | Stoecklein et al. | 239/96 |
| 8,875,566 | B2 | 11/2014 | Hoffmann et al. | 73/114.45 |
| 9,121,378 | B2 | 9/2015 | Katzenberger et al. | |
| 9,133,805 | B2 | 9/2015 | Uhlmann | |
| 9,279,400 | B2 | 3/2016 | Doehring et al. | |
| 2004/0144868 | A1 | 7/2004 | Yoshimura et al. | 239/533.2 |
| 2006/0032940 | A1 | 2/2006 | Boecking | 239/88 |
| 2006/0186221 | A1 * | 8/2006 | Heinz | F02M 51/0603 239/88 |
| 2006/0289681 | A1 | 12/2006 | Boecking | 239/533.3 |
| 2007/0261673 | A1 | 11/2007 | Rueckle et al. | 123/445 |
| 2008/0053410 | A1 | 3/2008 | Gant | 123/472 |
| 2009/0065614 | A1 | 3/2009 | Ganser | 239/584 |
| 2009/0205614 | A1 | 8/2009 | Hlousek et al. | 123/476 |
| 2009/0266340 | A1 | 10/2009 | Eisenmenger et al. | 123/494 |
| 2010/0038457 | A1 | 2/2010 | Yurtseven | 239/533.9 |
| 2012/0152206 | A1 | 6/2012 | Adachi et al. | 123/445 |
| 2014/0251276 | A1 * | 9/2014 | Schurz | F02M 51/0603 123/456 |
| 2015/0184627 | A1 * | 7/2015 | Schuerz | F02M 63/0026 123/478 |
| 2015/0292462 | A1 | 10/2015 | Jagani et al. | 239/102.2 |

FOREIGN PATENT DOCUMENTS

| | | | | |
|---|---|---|---|---|
| CN | 101331312 | A | 12/2008 | F02M 47/02 |
| CN | 102483018 | A | 5/2012 | F02M 47/02 |
| DE | 10326045 | A1 | 12/2004 | F02M 45/08 |
| DE | 10326046 | A1 | 12/2004 | F02M 47/00 |
| DE | 102004054589 | A1 | 5/2006 | F02M 47/00 |
| DE | 102005030137 | A1 | 1/2007 | F02M 51/06 |
| DE | 102006011293 | A1 | 9/2007 | H01L 41/083 |
| DE | 102007006941 | A1 | 8/2008 | F02M 47/02 |
| DE | 102007051554 | A1 | 4/2009 | F02M 47/02 |
| DE | 102008002416 | A1 | 12/2009 | F02M 51/06 |
| DE | 102009002554 | A1 | 1/2010 | F02M 47/02 |
| DE | 102009039647 | A1 | 3/2011 | F02M 47/02 |
| DE | 102010039051 | A1 | 2/2012 | F01N 3/10 |
| DE | 102011056406 | A1 | 6/2012 | F02M 47/02 |
| DE | 102011003443 | A1 | 8/2012 | F02M 51/06 |
| EP | 0477400 | A1 | 4/1992 | F02M 51/06 |
| EP | 1433952 | A2 | 6/2004 | F02M 47/00 |
| EP | 1508690 | A1 | 2/2005 | F02M 51/06 |
| EP | 1508690 | B1 | 10/2006 | F02M 51/06 |
| EP | 1840366 | A2 | 10/2007 | F02M 51/06 |
| EP | 1983186 | A2 | 10/2008 | F02M 47/02 |
| EP | 2511514 | A2 | 10/2012 | F02M 47/02 |
| GB | 2296940 | A | 7/1996 | F02M 21/02 |
| WO | 01/23741 | A1 | 4/2001 | F02M 45/04 |
| WO | 2003/064847 | A1 | 8/2003 | F02M 51/06 |
| WO | 2005/019637 | A1 | 3/2005 | F02M 45/08 |
| WO | 2005/075811 | A1 | 8/2005 | F02M 51/06 |
| WO | 2007/098621 | A1 | 9/2007 | F02M 47/02 |
| WO | 2012/113796 | A1 | 8/2012 | F02D 41/20 |
| WO | 2012/126736 | A1 | 9/2012 | F02D 41/20 |
| WO | 2013/010929 | A1 | 1/2013 | F02M 51/06 |
| WO | 2014/012795 | A1 | 1/2014 | F02M 61/16 |
| WO | 2014/086933 | A1 | 6/2014 | F02M 47/02 |
| WO | 2014/095910 | A1 | 6/2014 | F02M 51/06 |

OTHER PUBLICATIONS

U.S. Final Office Action, U.S. Appl. No. 14/234,039, 15 pages, dated Jul. 1, 2016.
International Search Report and Preliminary Report on Patentability, Application No. PCT/EP2012/063753, 9 pages, dated Dec. 12, 2012.
International Search Report and Written Opinion, Application No. PCT/EP2013/064111, 15 pages, dated Sep. 9, 2013.
International Search Report and Written Opinion, Application No. PCT/EP2013/076961, 18 pages, dated Mar. 28, 2014.
U.S. Non-Final Office Action, U.S. Appl. No. 14/234,039, 16 pages, dated Jan. 15, 2016.
U.S. Non-Final Office Action, U.S. Appl. No. 14/653,334, 10 pages, dated May 20, 2016.
Chinese Office Action, Application No. 201380063761.5, 12 pages, dated Oct. 8, 2016.
U.S. Non-Final Office Action, U.S. Appl. No. 14/653,334, 16 pages, dated Dec. 23, 2016.
U.S. Advisory Action, U.S. Appl. No. 14/234,039, 3 pages, dated Nov. 4, 2016.
U.S. Final Office Action, U.S. Appl. No. 14/653,334, 13 pages, dated Nov. 4, 2016.
U.S. Notice of Allowance, U.S. Appl. No. 14/415,332, 11 pages, dated Apr. 9, 2018.
U.S. Final Office Action, U.S. Appl. No. 14/234,039, 23 pages, dated Aug. 10, 2017.
U.S. Non-Final Office Action, U.S. Appl. No. 14/234,039, 19 pages, dated Jan. 12, 2018.
Chinese Office Action, Application No. 201380062531.7, 14 pages, dated Oct. 8, 2016.
U.S. Non-Final Office Action, U.S. Appl. No. 14/234,039, 32 pages, dated Feb. 9, 2017.
Indian Office Action, Application No. 57/DELNP/2014, 10 pages, dated Aug. 1, 2018.
U.S. Non-Final Office Action, U.S. Appl. No. 14/415,332, 45 pages, dated Oct. 31, 2017.
U.S. Final Office Action, U.S. Appl. No. 14/234,039, 19 pages, dated Jul. 26, 2018.
U.S. Non-Final Office Action, U.S. Appl. No. 14/234,039, 18 pages, dated Dec. 28, 2018.
Indian Office Action, Application No. 3678/DELNP/2015, 6 pages, dated Apr. 10, 2019.

* cited by examiner

PIEZO INJECTOR

CROSS-REFERENCE TO RELATED APPLICATIONS

This application is a U.S. National Stage Application of International Application No. PCT/EP2013/075693 filed Dec. 5, 2013, which designates the United States of America, and claims priority to DE Application No. 10 2012 222 509.9 filed Dec. 7, 2012, the contents of which are hereby incorporated by reference in their entirety.

TECHNICAL FIELD

The invention relates to a piezo injector, in particular a piezo injector for an internal combustion engine with direct fuel injection.

BACKGROUND

In internal combustion engines with direct fuel injection, fluid injectors are used for the metering of fuel. With regard to high demands placed on internal combustion engines arranged in motor vehicles, for example with regard to highly targeted performance setting and/or the adherence to stringent pollutant emissions, precise metering of the fuel by means of the respective injector is important.

The injection quantity of injectors is controlled for example by means of a servo valve. It is also possible for the nozzle needle of the injector to be driven directly by means of a piezo element.

For this purpose, virtually play-free coupling between the piezo actuator and the nozzle needle is important.

SUMMARY

One embodiment provides a piezo injector, comprising an actuator chamber; a piezo actuator arranged in the actuator chamber; a control piston bore; a control piston arranged in the control piston bore, the control piston have a face side; a leakage pin arranged between the piezo actuator and the face side to couple the piezo actuator to the control piston; and a connection for fluid communication with the control piston bore, the connection having a hydraulic throttle.

In a further embodiment, the piezo injector comprises a first control chamber formed by a section of the control piston bore that is delimited by the face side; a nozzle needle having a face side, wherein the nozzle needle guides a nozzle needle sleeve; and a second control chamber delimited by the nozzle needle sleeve and by the face side of the nozzle needle; wherein the connection for fluid communication is formed between the first and the second control chamber.

In a further embodiment, the piezo injector comprises a spring chamber formed by the section of the control piston bore that faces away from the piezo actuator and by the control piston, wherein the connection for fluid communication is formed between the spring chamber and a high-pressure region.

In a further embodiment, the throttle is designed such that the throttle exhibits a throughflow in the range from 300 ml/min to 600 ml/min.

In a further embodiment, the throttle has a minimum diameter in the range from 0.2 mm to 0.4 mm.

In a further embodiment, the throttle is designed such that a throughflow rate through the throttle in one direction differs from a throughflow rate through the throttle in the opposite direction.

In a further embodiment, the throughflow rate in the direction of the second control chamber is lower than the throughflow rate in the direction of the first control chamber.

In a further embodiment, the throughflow rate in the direction of the spring chamber is lower than the throughflow rate in the direction of the high-pressure region.

BRIEF DESCRIPTION OF THE DRAWINGS

Example embodiments are discussed below with reference to the figures, in which.

DETAILED DESCRIPTION

Figure 1:
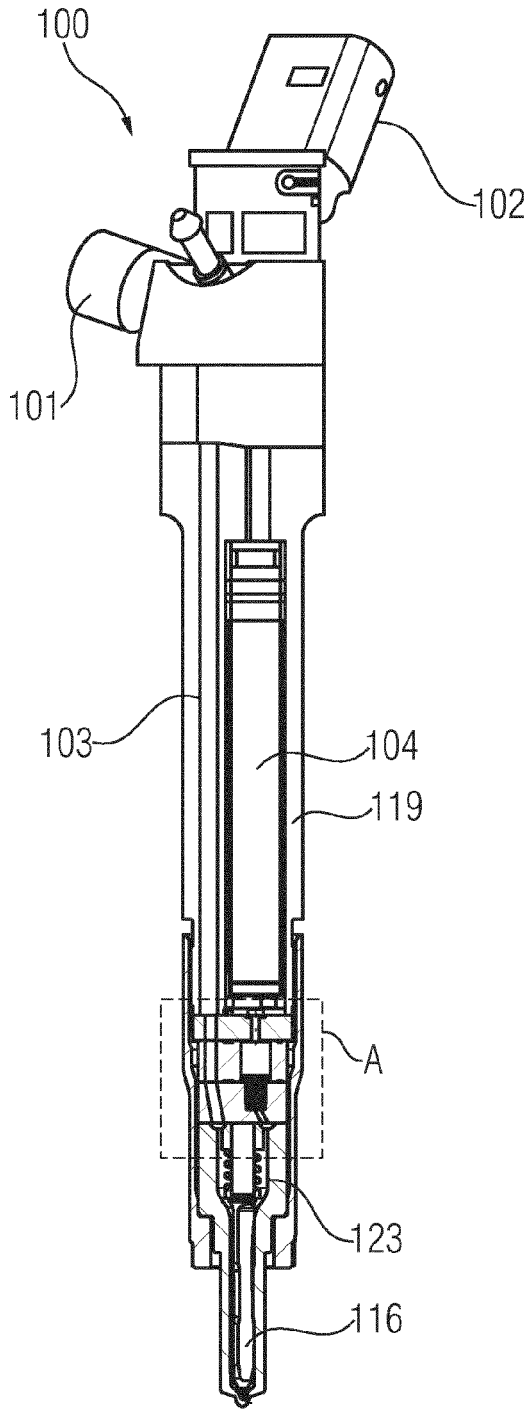
FIG. 1 shows, in a schematic illustration, a cross-sectional view of a piezo injector according to an embodiment.

In one embodiment of the invention, a piezo injector comprises an actuator chamber in which a piezo actuator is arranged. The piezo injector comprises a control piston bore in which a control piston is arranged. The control piston has a face side. The piezo injector furthermore has a leakage pin which is arranged between the piezo actuator and the face side in order to couple the piezo actuator to the control piston. The piezo injector has a connection for fluid communication with the control piston bore, which connection has a hydraulic throttle.

By means of the hydraulic throttle, it is possible for the inflow and/or outflow of a fluid into and/or out of the control bore to be dampened. In this way, it is possible to dampen the movement of the control piston. It is thus possible to reduce an undefined movement of the control piston, for example an overshoot. Thus, the control piston reliably follows a movement predefined by the piezo actuator. Reliable operation of the piezo injector is made possible in this way.

In further embodiments, the piezo injector comprises a first control chamber which is formed by a section, delimited by the face side, of the control piston bore. The piezo injector comprises a nozzle needle with a face side. The nozzle needle guides a nozzle needle sleeve. The piezo injector comprises a second control chamber which is delimited by the nozzle needle sleeve and the face side of the nozzle needle. The connection for fluid communication is formed between the first and the second control chamber.

Hydraulic coupling between the piezo actuator and the nozzle needle is made possible by the first and the second control chamber and the connection for fluid communication between the two control chambers. Said hydraulic coupling advantageously effects play compensation and a stroke boosting action. In this way, temperature effects, wear at contact points in the drive and changes in length in the piezo actuator caused by changes in the state of polarization of the piezo actuator can be compensated. This makes it possible for the piezo actuator to be manufactured from virtually any desired material, without the need to allow for thermal expansion characteristics of the material. It is thus possible, for example, to use a particularly high-pressure resistant material. The fluid flow from the first to the second control chamber and vice versa is dampened by the throttle. Thus, the movement of the piezo actuator is transmitted reliably to the nozzle needle. An undefined movement of the nozzle needle can thus be reduced.

According to further embodiments, the piezo injector comprises a spring chamber which is formed by that section of the control piston bore which faces away from the piezo actuator and by the control piston. The connection for fluid communication is formed between the spring chamber and the high-pressure region.

By virtue of the fact that the throttle is formed in the connection between the spring chamber and the high-pressure region, it is possible for the movement of the control piston to be dampened. The fluid flow to the spring chamber and out of the spring chamber is dampened. It is thus possible for an undefined movement of the control piston to be prevented. In this way, reliable operation of the piezo injector is made possible.

The throttle is formed either in the connection between the first and the second control chamber or in the connection between the spring chamber and the high-pressure region.

According to further embodiments, a throttle is arranged both in the connection between the first and the second control chamber and in the connection between the spring chamber and the high-pressure region.

According to embodiments, the throughflow rate through the throttle in one direction differs from a throughflow rate through the throttle in the opposite direction. It is thus possible, for example, for the throttle throughflow during the opening of the needle to differ from the throttle throughflow during the closing of the needle. In particular, the throttle is designed such that the damping action in the direction of the closing of the needle is less than that in the direction of the opening of the needle. Fast closing of the nozzle needle is thus ensured. Efficient operation of the internal combustion engine is thus possible.

FIG. 1 schematically shows a piezo injector 100. The piezo injector 100 may serve for the injection of fuel into an internal combustion engine. The piezo injector 100 may for example serve for the injection of diesel fuel into a common-rail internal combustion engine. The piezo injector 100 may also be used for the injection of gasoline or some other fuel.

The piezo injector 100 has a high-pressure port 101 via which highly pressurized fuel can be supplied. A high-pressure bore 103 in a housing 125 of the piezo injector 100 is hydraulically coupled to the high-pressure port 101. The high-pressure bore 103 runs in the longitudinal direction through the piezo injector 100 to a high-pressure region 123.

The piezo injector 100 has an actuator chamber 119 in which a piezo actuator 104 is arranged. The piezo actuator 104 is for example a fully active piezo stack. The piezo actuator 104 has an approximately cylindrical shape and can have an electrical voltage applied to it via an electrical connector 102 in order for the length of the piezo actuator 104 in the longitudinal direction to be varied.

A nozzle needle 116 is arranged in the high-pressure region 123. The change in length of the piezo actuator 104 is transmitted hydraulically to the nozzle needle 116. The coupling of the piezo actuator 104 to the nozzle needle 116 will be discussed below in conjunction with FIGS. 2 to 4, which show a more detailed view of the detail A indicated in FIG. 1.

Figure 2:
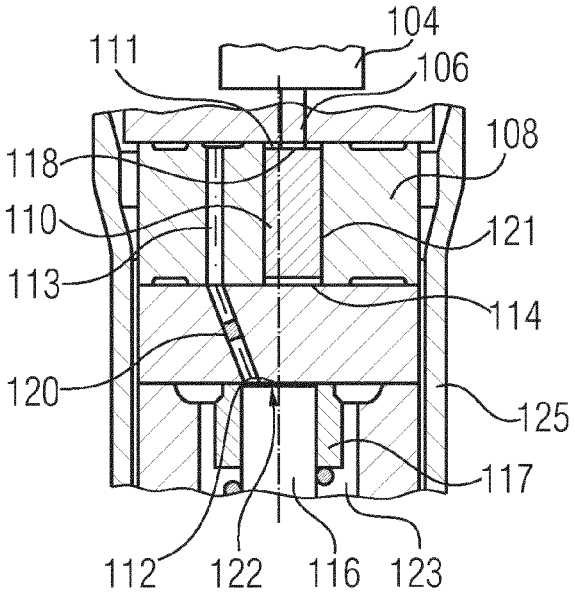
FIG. 2 shows, in a schematic illustration, a cross-sectional view of a detail of the piezo injector according to an embodiment.

FIG. 2 schematically shows a detail view of the detail A indicated in FIG. 1 according to embodiments.

The piezo injector 100 has a control piston bore 121 in a control plate 108, in which control piston bore there is arranged a control piston 110. The control piston 110 has a face side 118 pointing in the direction of the piezo actuator 104. A section of the control piston bore 121 that is delimited by the face side 118 forms a first control chamber 111. At its longitudinal end situated opposite the first control chamber 111, the control piston bore 121 forms a spring chamber 114. The control piston is thus formed between the first control chamber 111 and the spring chamber 114.

Figure 3:
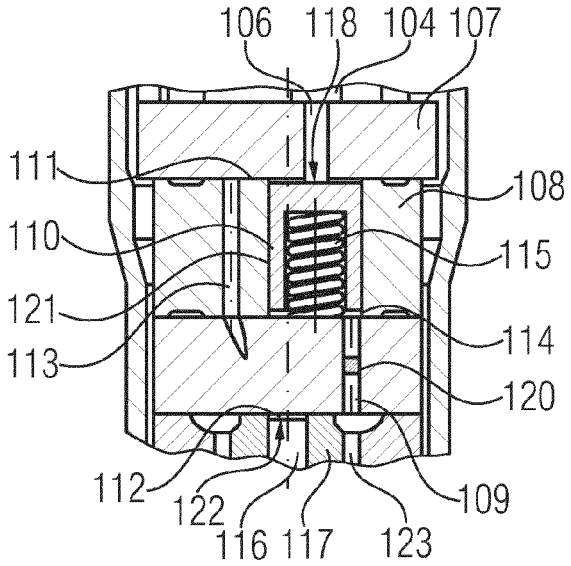
FIG. 3 shows, in a schematic illustration, a cross-sectional view of a detail of a piezo injector according to an embodiment.
Figure 4:
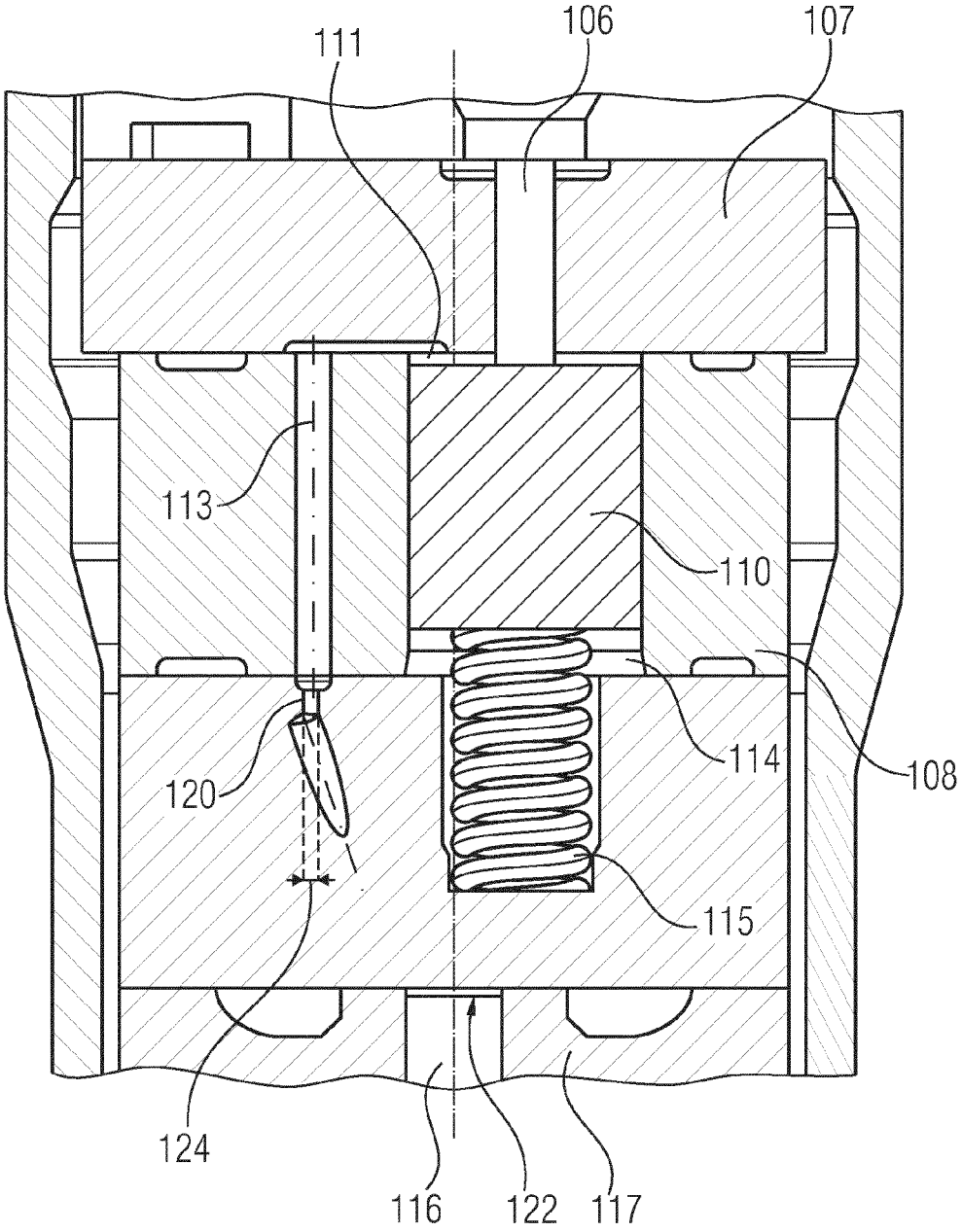
FIG. 4 shows, in a schematic illustration, a cross-sectional view of a detail of a piezo injector according to an embodiment.

In the spring chamber 114 there is situated a spring 115 (FIGS. 3 and 4). The spring 115 is for example in the form of a helical compression spring. A first longitudinal end of the spring 115 is supported on the control piston 110. A second longitudinal end of the spring 115 is supported on a face side of the control piston bore 121. The spring 115 subjects the control piston 110 to a force acting in the direction of the first control chamber 111.

The spring chamber 114 is connected via a high-pressure connection 109 (FIG. 3) to the high-pressure region 123. Thus, the spring chamber 114 always has situated within it fuel with the pressure prevailing in the high-pressure bore 103.

A leakage pin 106 is arranged between the piezo actuator 104 and the control piston bore 121. The leakage pin 106 is designed to transmit an increase in length of the piezo actuator 104 to the control piston 110. The leakage pin 106 is held by an intermediate plate 107.

The nozzle needle 116 is arranged in the high-pressure region 123, on the upper region of which nozzle needle a nozzle needle sleeve 117 is guided. An end of the nozzle needle 116 that points in the direction of the piezo actuator 104 has a face side 122. Above the face side 122 there is formed a second control chamber 112 which is delimited by the second face side 122 and by the nozzle needle sleeve 117. The second control chamber 112 is hydraulically connected to the first control chamber 111 by way of a connection 113.

The nozzle needle 116 is for example subjected by a helical compression spring to a force directed away from the second control chamber 112.

In the closed state of the piezo injector 100, the nozzle needle 116 bears against a lower tip of the piezo injector 100. The piezo actuator 104 is discharged and exhibits its minimum length. The piezo injector 100 does not perform an injection of fuel.

If the piezo actuator 104 is charged via the electrical connector 102 and thus the length of the piezo actuator 104 is increased, the piezo actuator 104 exerts a force on the control piston 110 via the leakage pin 106, as a result of which the control piston 110 is moved in the control piston bore 103 in the direction of the spring chamber 114. The volume of the first control chamber 111 is thus increased, whereby the pressure in the first control chamber 111 and in the second control chamber 112 falls. Thus, the reduced pressure in the second control chamber 112 exerts a now reduced force on the face side 122 of the nozzle needle 116. The high pressure of the high-pressure region 123, which continues to act on the lower end of the nozzle needle 116, consequently effects a movement of the nozzle needle 116 upward in the direction of the second control chamber 112. The piezo injector 100 is thus opened in order to inject fuel.

A transmission ratio between a change in length of the piezo actuator 104 and a stroke of the nozzle needle 116 is set by way of the ratio of the diameter of the control piston 110, and thus the diameter of the first control chamber 111, to the diameter of the nozzle needle 116 at its face side 122, and thus to the diameter of the second control chamber 112.

If the piezo actuator 104 is subsequently discharged and thus decreases in length, the high pressure prevailing in the spring chamber 114 and the force exerted on the control piston 110 by the spring 115 effects a movement of the control piston 110 in the direction of the first control chamber 111. As a result, the pressure in the first control chamber 111 and thus also the pressure in the second control chamber 112 increase. This results in a return movement of the nozzle needle 116 to the lower end of the piezo injector 100, whereby the piezo injector 100 is closed and the injection of fuel is ended.

A throttle 120 is arranged in the connection 113 between the first control chamber 111 and the second control chamber 112. The throttle 120 dampens the fluid flow between the two control chambers 111 and 112. Thus, the speed of the pressure increase in the control chamber 111 during a movement of the nozzle needle 116 upward in the direction of the second control chamber 112 is reduced. Thus, an oscillation amplitude of the nozzle needle 116 is also reduced. An excessive acceleration and overshoot of the nozzle needle 116 are thus prevented. These may arise conventionally because, during the opening movement of the nozzle needle 116 for the injection of the fuel, the pressure in the blind bore below the needle seat rises very rapidly to almost the pressure in the high-pressure bore 103. The hydraulic closing force on the nozzle needle 116 falls by the same extent. As a result, the force required for opening the nozzle needle 116 is significantly higher than the force required for holding the nozzle needle 116 in the open position. The piezo actuator 104 and the hydraulic path to the seat of the nozzle needle 116 are elastically preloaded from the beginning of the injection process until the opening of the nozzle needle. In this case, the pressure in the two control chambers 111 and 112 is reduced to a value considerably lower than that required for holding the nozzle needle 116 in the open position. After the nozzle needle 116 has lifted from the seat, the elastic preload is depleted. In this way, the nozzle needle is conventionally subjected to intense acceleration, and overshoots. The resulting oscillation amplitude, which leads to intensely non-linear quantity characteristic curves, which are disadvantageous for transient operation of the internal combustion engine, can be prevented through the use of the throttle 120.

By means of the throttle 120, it is possible for the speed of the pressure increase in the first control chamber 111 after the nozzle needle 116 has lifted from the seat to be reduced. In this way, the oscillation amplitude of the nozzle needle 116 is also reduced. The throughflow rate through the throttle 120 is predefined in a manner dependent on the energization profiles of the piezo actuator 104, such that the quantity characteristic curves exhibit adequate linearity even without the use of a needle stop for the nozzle needle 116. An overshoot of the nozzle needle 116 is dampened, and thus the linearity of the quantity characteristic curves is increased. It is thus possible to dispense with a needle stop which delimits the needle oscillations. It is thus possible even in the case of relatively small injection quantities for the needle oscillations of the nozzle needle 116 to be reduced.

For example, the throttle 120 exhibits a throughflow rate in a range from 300 to 600 ml/min. For example, during the measurement process at the manufacturing stage, the throttle 120 exhibits a pressure difference of 100 to 60 bar. The throttle throughflow rate is configured such that, in particular during the closing of the nozzle needle 116, the nozzle needle movement relative to the movement of the piezo actuator 104 is maintained.

The movement of the control piston 110 is dampened by the throttle 120. The movement of the nozzle needle 116 is dampened by the throttle 120. Thus, the nozzle needle 116 reliably follows the movement of the control piston 110 during the opening of the piezo injector 100 and while the latter is held open.

For example, the throttle 120 has a diameter 124 (FIG. 4) in the range from 0.25 to 0.35 mm. The throttle 120 is produced for example by drilling or by erosion. In exemplary embodiments, the throttle 120 is rounded by way of a hydroerosive grinding process. A stable throttle throughflow is thus ensured over the service life of the throttle 120.

According to embodiments, the throttle 120 is designed such that the throughflow rate in the flow direction through the connection 113 during the opening of the nozzle needle 116 differs from the throughflow rate in the flow direction through the connection 113 during the closing of the nozzle needle 116. In particular, the throughflow rate in the direction of the second control chamber 122 is lower than that in the direction of the first control chamber 111.

LIST OF REFERENCE NUMERALS

100 Piezo injector
101 High-pressure port
102 Electrical connector
103 High-pressure bore
104 Piezo actuator
106 Leakage pin
107 Intermediate plate
108 Control plate
109, 113 Connection
110 Control piston
111 First control chamber
112 Second control chamber
114 Spring chamber
115 Spring
116 Nozzle needle
117 Nozzle needle sleeve
118 First face side
119 Actuator chamber
120 Throttle
121 Control piston bore
122 Face side
123 High-pressure region
124 Diameter
125 Housing

What is claimed is:

1. A piezo injector of an internal combustion engine, the piezo injector comprising:

an actuator chamber, a piezo actuator arranged in the actuator chamber, a control piston bore, a control piston arranged in the control piston bore, the control piston having a face side and a perimeter in sliding contact with walls of the control piston bore, a first control chamber delimited by the walls of the control piston bore having straight sides and the face side of the control piston, the first control chamber disposed between the face side of the control piston and the actuator chamber, a rigid leakage pin sliding within an intermediate plate arranged between the piezo actuator and the face side of the control piston to transmit an increase in length of the piezo actuator to the control piston through direct physical contact with both the piezo actuator and the control piston, a nozzle needle guided in a high-pressure region of the piezo injector by a nozzle needle sleeve, a second control chamber formed within the nozzle needle sleeve and delimited by a face side of the nozzle needle, a connection for fluid communication between the first control chamber and the second control chamber, and a hydraulic throttle disposed in the connection for fluid communication, wherein the control piston, the first control chamber, the second control chamber, and the connection are physically interrelated such that a movement of the control piston toward the nozzle needle increases a volume of the first control chamber to thereby reduce a fluid pressure in both the first control chamber and the second control chamber to thereby reduce a pressure exerted on the face side of the nozzle needle.

2. The piezo injector of claim 1, further comprising:

a spring chamber formed by a section of the control piston bore that faces away from the piezo actuator and by the control piston, wherein a second connection for fluid communication is formed between the spring chamber and the high-pressure region.

3. The piezo injector of claim 1, in which the throttle exhibits a throughflow in the range from 300 ml/min to 600 ml/min.

4. The piezo injector of claim 1, wherein the throttle has a minimum diameter in the range from 0.2 mm to 0.4 mm.

5. The piezo injector of claim 1, in which the throttle is designed such that a throughflow rate through the throttle in one direction differs from a throughflow rate through the throttle in the opposite direction.

6. The piezo injector of claim 5, wherein the throughflow rate of the connection for fluid communication in the direction of the second control chamber is lower than the throughflow rate in the direction of the first control chamber.

7. The piezo injector of claim 5, further comprising:

a spring chamber formed by a section of the control piston bore that faces away from the piezo actuator and by the control piston, a second connection for fluid communication between the spring chamber and the high-pressure region, and wherein the throughflow rate of the second connection in the direction of the spring chamber is lower than the throughflow rate in the direction of the high-pressure region.

8. The piezo injector of claim 1, wherein a diameter of the first control chamber is defined by a diameter of the face side of the control piston.

* * * * *